US010927048B1

(12) United States Patent
Hays

(10) Patent No.: US 10,927,048 B1
(45) Date of Patent: Feb. 23, 2021

(54) GUNPOWDER PREPARATION SYSTEM AND METHOD OF MAKING THE SAME

(71) Applicant: Thomas Edward Hays, Galveston, TX (US)

(72) Inventor: Thomas Edward Hays, Galveston, TX (US)

( * ) Notice: Subject to any disclaimer, the term of this patent is extended or adjusted under 35 U.S.C. 154(b) by 450 days.

(21) Appl. No.: 15/849,935

(22) Filed: Dec. 21, 2017

Related U.S. Application Data

(60) Provisional application No. 62/437,288, filed on Dec. 21, 2016.

(51) Int. Cl.
*C06B 21/00* (2006.01)
*C06B 31/04* (2006.01)

(52) U.S. Cl.
CPC ..... *C06B 21/0008* (2013.01); *C06B 21/0091* (2013.01); *C06B 31/04* (2013.01)

(58) Field of Classification Search
None
See application file for complete search history.

(56) References Cited

U.S. PATENT DOCUMENTS 2,423,427 A * 7/1947 Payn ..... C06B 31/06 149/73
4,997,496 A * 3/1991 Wehrli ..... C06B 31/28 149/18
5,750,921 A * 5/1998 Chan ..... C06B 21/0025 149/11
6,740,710 B1 * 5/2004 Wick ..... C06B 21/0083 525/123
2009/0223611 A1 * 9/2009 Racette ..... C06B 45/105 149/4

* cited by examiner

*Primary Examiner* — Aileen B Felton
(74) *Attorney, Agent, or Firm* — Richard Eldredge; Leavitt Eldredge Law Firm

(57) ABSTRACT

A method of preparing gunpowder includes selecting a known combination of chemicals used in making gunpowder; mixing the known combination of chemicals and a measurement of liquid ammonia at a predetermined temperature; stirring the chemicals and liquid ammonia with a laboratory mechanical stirrer, causing the chemicals to blend at a molecular level; raising the temperature of the mixture, causing the liquid ammonia to evaporate from the mixture, while keeping the mixture significantly below ignition temperature; allowing the remaining mixture to warm, thereby reducing the risk of ignition; and resulting in a fine gunpowder mixture, with no water content and limited recrystallization of the chemicals.

4 Claims, 4 Drawing Sheets

GUNPOWDER PREPARATION SYSTEM AND METHOD OF MAKING THE SAME

BACKGROUND

1. Field of the Invention

The present invention relates generally to explosives systems, and more specifically, to a gunpowder preparation system for improved burning efficiency.

2. Description of Related Art

Explosives systems are well known in the art and are effective means to make gunpowder. For example, FIG. 1 depicts a conventional gunpowder preparation system 101 having a well-known combination of potassium nitrate 103, charcoal 105, and sulfur 107, mixed together in a milling machine 109 with water 111.

In FIG. 2 a flowchart 201 depicts the method of system 101. The potassium nitrate 103, charcoal 105, and sulfur 107 are added to the milling machine 109 and mixed, as shown with boxes 203, 205. The mixing of the chemicals causes an explosive dust formation, therefore water 111 is frequently added to the milling machine 109 to reduce dust, as shown with box 207.

One of the problems commonly associated with system 101 is crystal formation. For example, the addition of water 111 causes the potassium nitrate 103 to recrystallize, thereby reducing the burning efficiency of the resulting gunpowder.

Accordingly, although great strides have been made in the area of gunpowder preparation systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
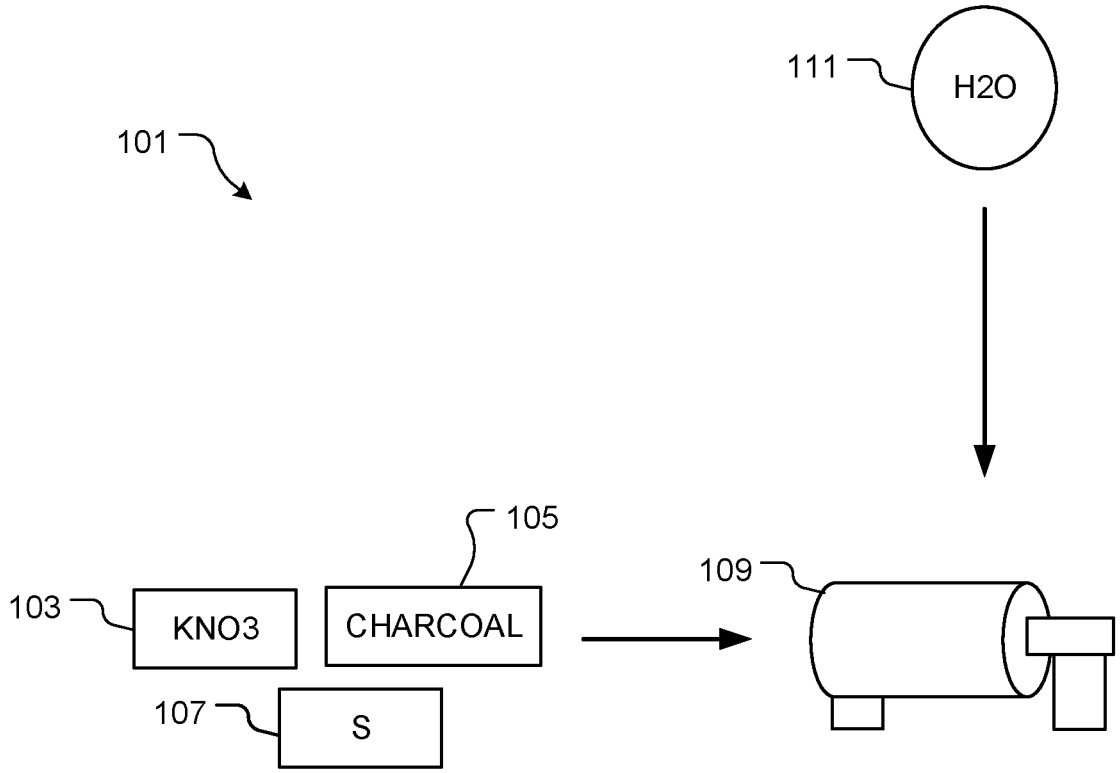
FIG. 1 (Prior Art)
FIG. 1 is a simplified diagram of a common gunpowder preparation system.
Figure 2:
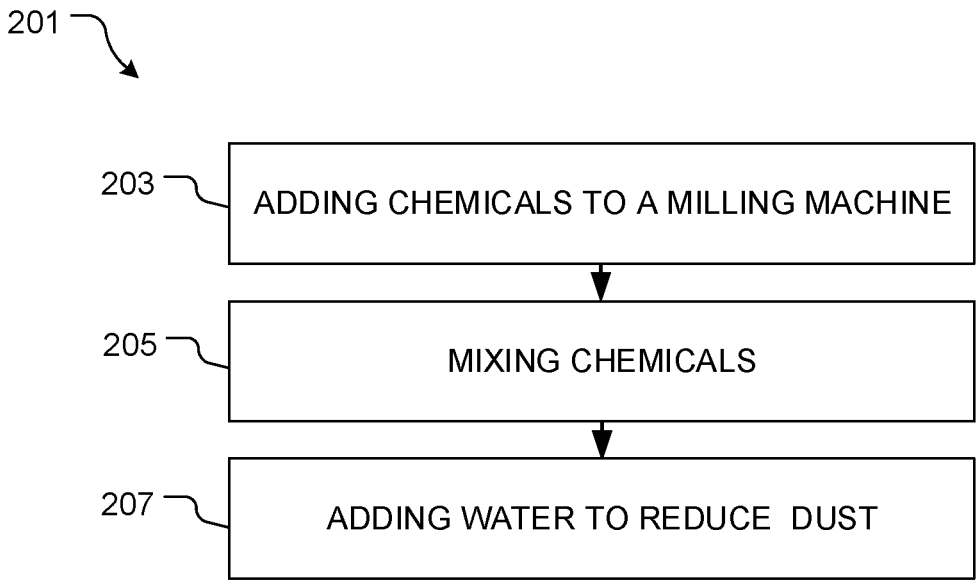
FIG. 2 (Prior Art)
FIG. 2 is a flowchart of the method of FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional gunpowder systems. Specifically, the present invention provides a method to prevent recrystallization during gunpowder preparation. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 3:
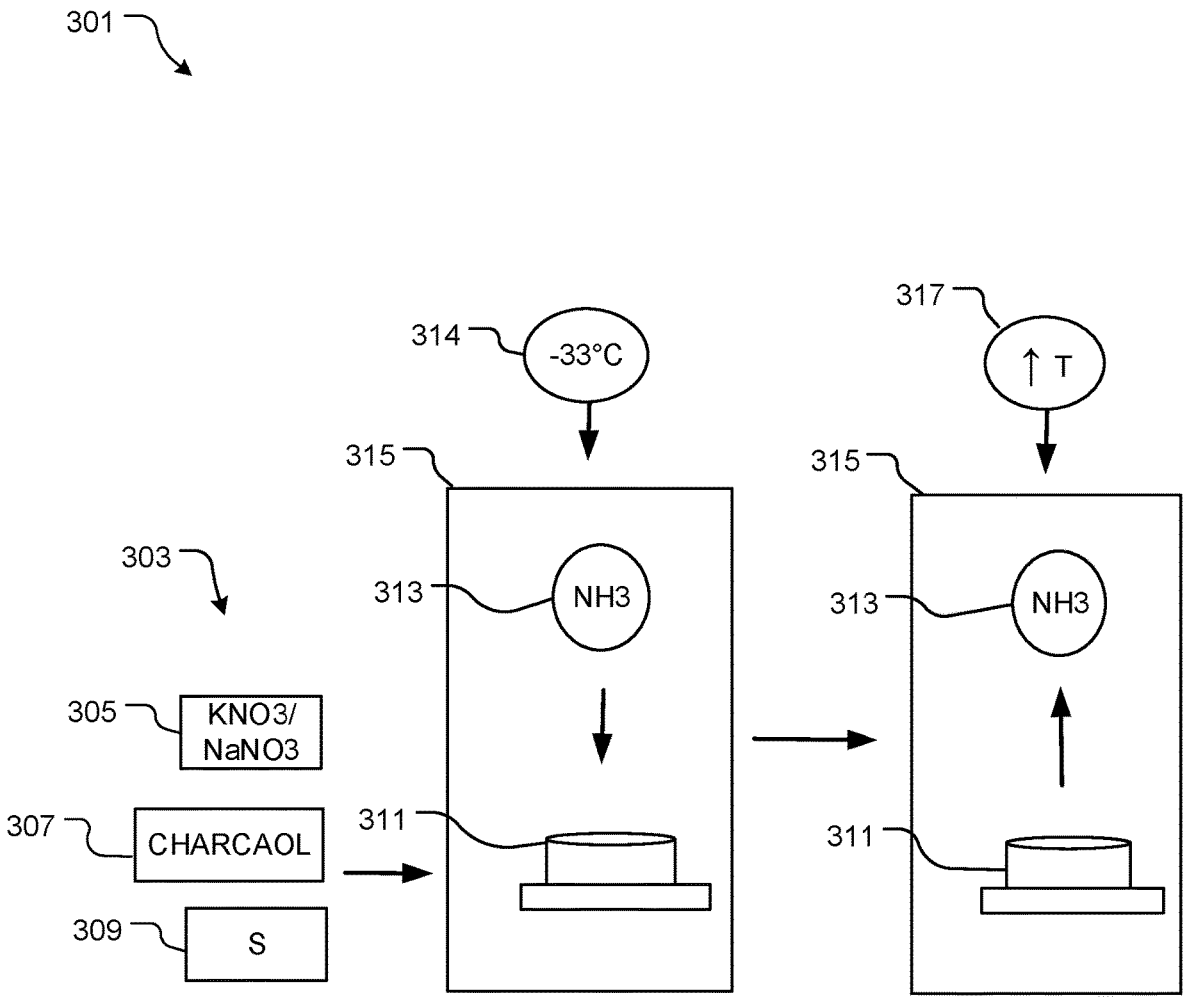
FIG. 3 is a simplified diagram of a gunpowder preparation system in accordance with a preferred embodiment of the present application.

Referring now to the drawings wherein like reference characters identify corresponding or similar elements throughout the several views, FIG. 3 depicts a simplified diagram of a gunpowder preparation system in accordance with a preferred embodiment of the present application. It will be appreciated that system 301 overcomes one or more of the above-listed problems commonly associated with conventional gunpowder systems.

In the contemplated embodiment, system 301 includes a combination of gunpowder chemicals 303, namely potassium nitrate, sodium nitrate, or ammonium nitrate 305, charcoal 307, and sulfur 309, added to a mechanical mixer 311 with liquid ammonia 313, at a temperature 314 below −33° C. It is contemplated that the mixing can take place inside a laboratory hood 315, and a temperature increase 317 will cause the liquid ammonia 313 to evaporate.

Figure 4:
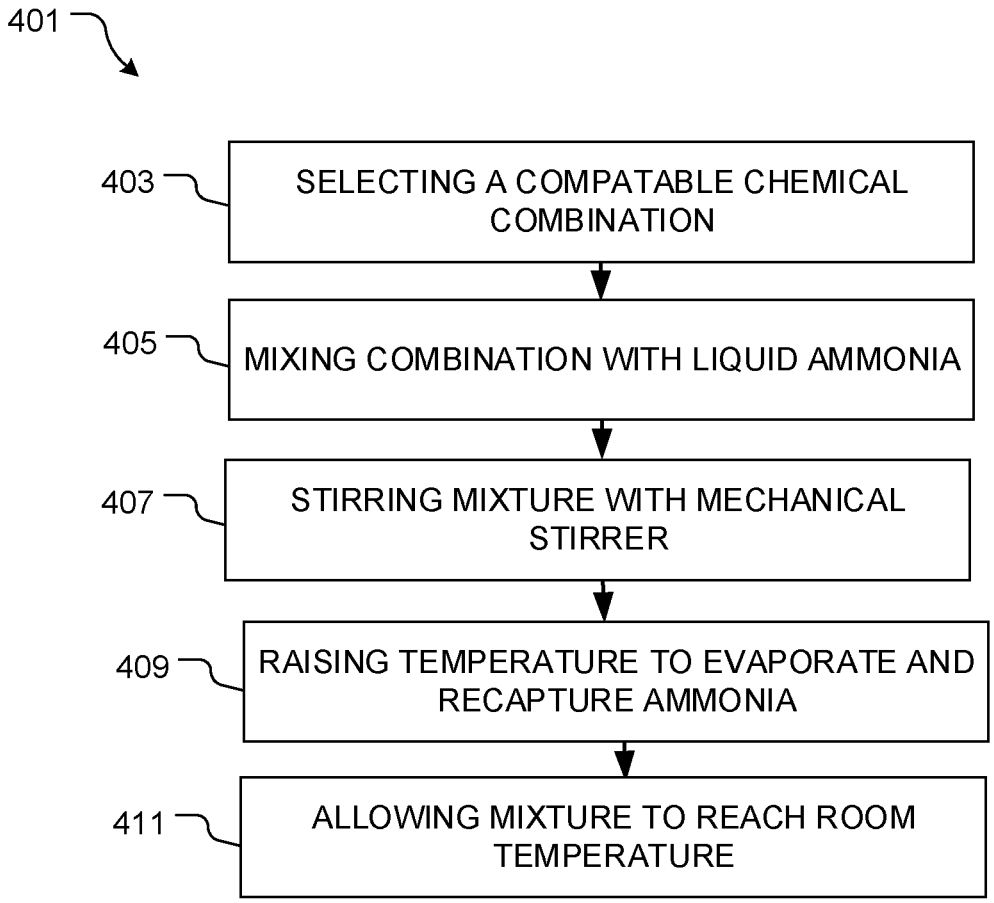
FIG. 4 is a flowchart of the method of FIG. 3.

In FIG. 4 a flowchart 401 depicts the method of making gunpowder associated with system 301. A known combination of chemicals 303 needed to make gunpowder is selected, as shown with box 403. The chemicals 303 are added to a mechanical mixer 311, such as a stirrer or blender, along with liquid ammonia 313, and kept at a temperature below −33° C., as shown with box 405. The mixture is stirred until the gunpowder chemicals 303 combine at a molecular level, at which point the temperature is allowed to rise above −33° C., causing the liquid ammonia 313 to evaporate from the mixture, whereby the ammonia can be cooled and recaptured inside the hood 315, as shown with boxes 407, 409. The resulting mixture is allowed to slowly reach room temperature, resulting in a stable, fine gunpowder, as shown with box 411.

It should be appreciated that one of the unique features believed characteristic of the present application is the use of liquid ammonia 313 during the mixing of gunpowder chemicals. It should be understood that the use of liquid ammonia 313 at a temperature below the liquid ammonia boiling point (−33° C.) will eliminate the need for using water to prevent dust formation, as in conventional gunpowder preparation systems, thereby preventing recrystallization of the potassium nitrate or sodium nitrate. It should be appreciated that the lack of crystallization improves the burning efficiency of the resulting gunpowder.

It should be appreciated that one known combination of chemicals needed to make gunpowder comprises approximately 10% by weight of sulfur, approximately 15% by weight of charcoal, and approximately 75% by weight of potassium nitrate, sodium nitrate, ammonium nitrate or a combination of these chemicals.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A method of making gunpowder, comprising:

selecting a known combination of chemicals used in making gunpowder;

mixing the known combination of chemicals and a measurement of liquid ammonia at a predetermined temperature;

stirring the chemicals and liquid ammonia with a laboratory mechanical stirrer, causing the chemicals to blend at a molecular level;

raising the temperature of the mixture, thereby causing the liquid ammonia to evaporate from the mixture, while keeping the mixture significantly below ignition temperature, thereby reducing the risk of ignition; and allowing the remaining mixture to warm slowly;

wherein the resulting matter in a fine gunpowder mixture, with no water content and therefore limited recrystallization of the chemicals.

2. The method of claim 1, wherein the predetermined temperature is below −33° Celcius.

3. The method of claim 1, further comprising:

recapturing the evaporated ammonia by cooling the evaporation under a laboratory hood to a temperature below −33° Celcius.

4. The method of claim 1, wherein the known combination of chemicals comprises: a sulfur;

a charcoal;

a potassium nitrate; a sodium nitrate; and an ammonium nitrate.

* * * * *